US007758479B2

(12) United States Patent
Husted et al.

(10) Patent No.: US 7,758,479 B2
(45) Date of Patent: Jul. 20, 2010

(54) LOADING DEVICE FOR EXERCISE MACHINES

(76) Inventors: Royce H. Husted, 1295 Old Elkton Dr., Forest, VA (US) 24551; Joel P. Husted, 1455 Old Elkton Dr., Forest, VA (US) 24551

( * ) Notice: Subject to any disclaimer, the term of this patent is extended or adjusted under 35 U.S.C. 154(b) by 1762 days.

(21) Appl. No.: 10/896,415

(22) Filed: Jul. 22, 2004

(65) Prior Publication Data

US 2006/0019807 A1 Jan. 26, 2006

(51) Int. Cl.
*A63B 21/00* (2006.01)

(52) U.S. Cl. ..... 482/100; 482/92

(58) Field of Classification Search ..... 482/110, 482/100, 112, 130, 126, 102, 73, 97, 909, 482/140

See application file for complete search history.

(56) References Cited

U.S. PATENT DOCUMENTS

| | | | | | |
|---|---|---|---|---|---|
| 3,638,941 | A * | 2/1972 | Kulkens | ..... | 482/113 |
| 4,426,077 | A * | 1/1984 | Becker | ..... | 482/92 |
| 4,477,071 | A * | 10/1984 | Brown et al. | ..... | 482/73 |
| 4,618,140 | A * | 10/1986 | Brown | ..... | 482/73 |
| 4,684,125 | A | 8/1987 | Lantz | ..... | 272/130 |
| 4,988,095 | A * | 1/1991 | Ferrari | ..... | 482/102 |
| 5,213,554 | A * | 5/1993 | Goldstein et al. | ..... | 482/52 |
| 5,722,921 | A * | 3/1998 | Simonson | ..... | 482/100 |
| 6,322,482 | B1 * | 11/2001 | Kim | ..... | 482/124 |
| 6,569,042 | B2 * | 5/2003 | LaChance et al. | ..... | 473/457 |
| 6,626,808 | B1 * | 9/2003 | Adams | ..... | 482/140 |
| 6,652,426 | B2 * | 11/2003 | Carter et al. | ..... | 482/100 |
| 7,048,677 | B2 * | 5/2006 | Mackert et al. | ..... | 482/102 |
| 2003/0114281 | A1 * | 6/2003 | Mackert et al. | ..... | 482/123 |
| 2004/0185988 | A1 * | 9/2004 | Hsiung et al. | ..... | 482/102 |

* cited by examiner

*Primary Examiner*—Jerome Donnelly
(74) *Attorney, Agent, or Firm*—Nicholas H. Camasto

(57) ABSTRACT

A loading device for an exercise machine includes a lever arm and a nitrogen gas compression spring in a force triangle that provides easy adjustment of the resistive load presented to a user. The nitrogen gas compression spring and the selected portion of the lever arm comprise two legs of the force triangle, with a slidable coupling selectively interconnecting the nitrogen gas compression spring with the lever arm at adjustment points on the lever arm. Both the nitrogen gas compression spring and the lever arm are pivotally mounted on a rigid member, with the distances between their pivots forming the third leg of the force triangle. The nitrogen gas compression spring exhibits a high resistance, a flat spring rate and is of rigid construction so that the lever arm and nitrogen gas compression spring are self-supported at all times. The nitrogen gas compression spring is coupled to the slidable coupling to produce a slight torque preload to maintain the contact orientation of the slidable coupling and the lever arm the same throughout the excursion of the lever arm for all force loadings.

6 Claims, 4 Drawing Sheets

LOADING DEVICE FOR EXERCISE MACHINES

BACKGROUND OF THE INVENTION AND PRIOR ART

The present invention relates generally to loading devices that connect to a handle or other user manipulated apparatus on an exercise machine. A wide variety of loading devices, including stacks of iron weights, bundles of bow springs, and various spring and lever systems have been used; yet most fail to provide convenient, finite adjustability of the load delivered. In exercise machines having bow springs, for example, the loading is changed by selecting among a few springs of differing resistance, which is somewhat inconvenient and lacks the advantage of the greater number of finite loads provided by spring and lever systems.

Lever and spring systems also present problems. Since they generally include a non-adjustable spring, the loading is changed by varying the leverage on the spring. It is difficult to conveniently vary the leverage because of the need to simultaneously change the lengths of two legs of the force triangle, without which the result is either (a) the starting position of the exercise is changed or (b) a change in compression or decompression of the spring is experienced. The latter is a particular problem because of the difficulty in making adjustments under spring loads.

One type of prior art device defines one leg of a force triangle as the selected one of a plurality of adjustment positions located along an arc that is equal to the radius of a second leg of the force triangle. With this solution, only a single leg of the force triangle need be changed for loading adjustments. Such an arrangement is shown in U.S. Pat. No. 3,638,941, issued Feb. 1, 1972 to Kulkens, where a coil tension spring is used to provide resistive load to the user. A coil tension spring is, however, generally undesirable because of its high spring rate that results in a rapid increase in loading through the exercise stroke. To reduce the effects of high spring rate, Kulkens preloads the spring in its rest (unactuated) position. But when in the rest position the tension of the preloaded spring forces the exercise arm against a stop and adjustment of the lever arm is still difficult and inconvenient.

U.S. Pat. No. 4,426,077, issued Jan. 17, 1984 to Becker discloses an exercise device that also includes a plurality of adjustment points located along an arc with a radius equal to the length of a preloaded spring leg of the force triangle. Becker addresses the preloaded spring adjustment problem by either (a) locking the spring in a partly extended state and moving the unloaded spring eye between adjustment points or (b) latching the rigid lever arm in a fixed position, and moving the loaded spring eye, via a roller, over the adjustment points. When the desired adjustment point is reached, Becker then either unlocks the spring or retracts the lever arm latch, as the case may be. The method is somewhat inconvenient in that the spring must be locked (or the lever arm latched) while the user is partially through an exercise stroke. Becker does describe a remote cable-actuated latching mechanism for reducing some of the inconvenience.

U.S. Pat. No. 4,684,125, issued Aug. 4, 1987 to Lantz shows a pair of parallelly aligned adjustment plates, each including an arcuately disposed pattern of mating adjustment holes, and a gas compression spring, the extended length of which comprises one leg of the force triangle. A removable pin couples the eye of the compression spring to the selected pair of adjustment holes. The lever arm, which would otherwise collapse when the pin is removed, must be supported by the user during load changes. The eye of the compression spring must also be visually aligned by the user with the desired pair of holes in the adjustment plates. When the pin is inserted through the selected hole pair, the lever arm is again supported by the compression spring. The task of simultaneously supporting the lever arm, aligning the compression spring eye, and inserting the pin is inconvenient, at best and difficult, at worst.

OBJECTS OF THE INVENTION

A principle object of the invention is to provide a novel loading device for an exercise machine.

Another object of the invention is to provide an improved loading device that is readily adjustable for providing different loading for the user.

A further object of the invention is to provide an exercise machine with an improved loading device.

A feature of the invention resides in the inclusion of a force triangle in which the variable lever arm and spring are self-supported at all times.

Another feature of the invention resides in a coupling mechanism for the variable lever arm and spring that is captivated, yet readily movable for changing the loading.

A further feature of the invention enhances smooth quiet operation of the exercise machine by slightly preloading the coupling mechanism in one direction on the lever arm.

BRIEF DESCRIPTION OF THE DRAWINGS

These and other objects and features of the invention will be apparent upon reading the following description in conjunction with the drawings in which.

SUMMARY OF THE INVENTION

The present invention comprises a loading device, having a plurality of finite load adjustment points, that includes an adjustable arrangement of a compression spring and a lever arm. The compression spring and the selected portion of the lever arm comprise two legs of a force triangle, with a slidable coupling interconnecting the compression spring and lever arm at any of the plurality of adjustment points. The proximal ends of both the compression spring and lever arm are pivotally mounted on a rigid member, with the distance between the two pivots forming the third leg of the force triangle. The compression spring in the preferred embodiment of the invention is a nitrogen gas cylinder, chosen for its high resistance, flat spring rate and rigid construction. With the inventive arrangement, the lever arm and compression spring are self-supported and the slidable coupling is captivated at all times.

DESCRIPTION OF THE PREFERRED EMBODIMENT

Figure 1:
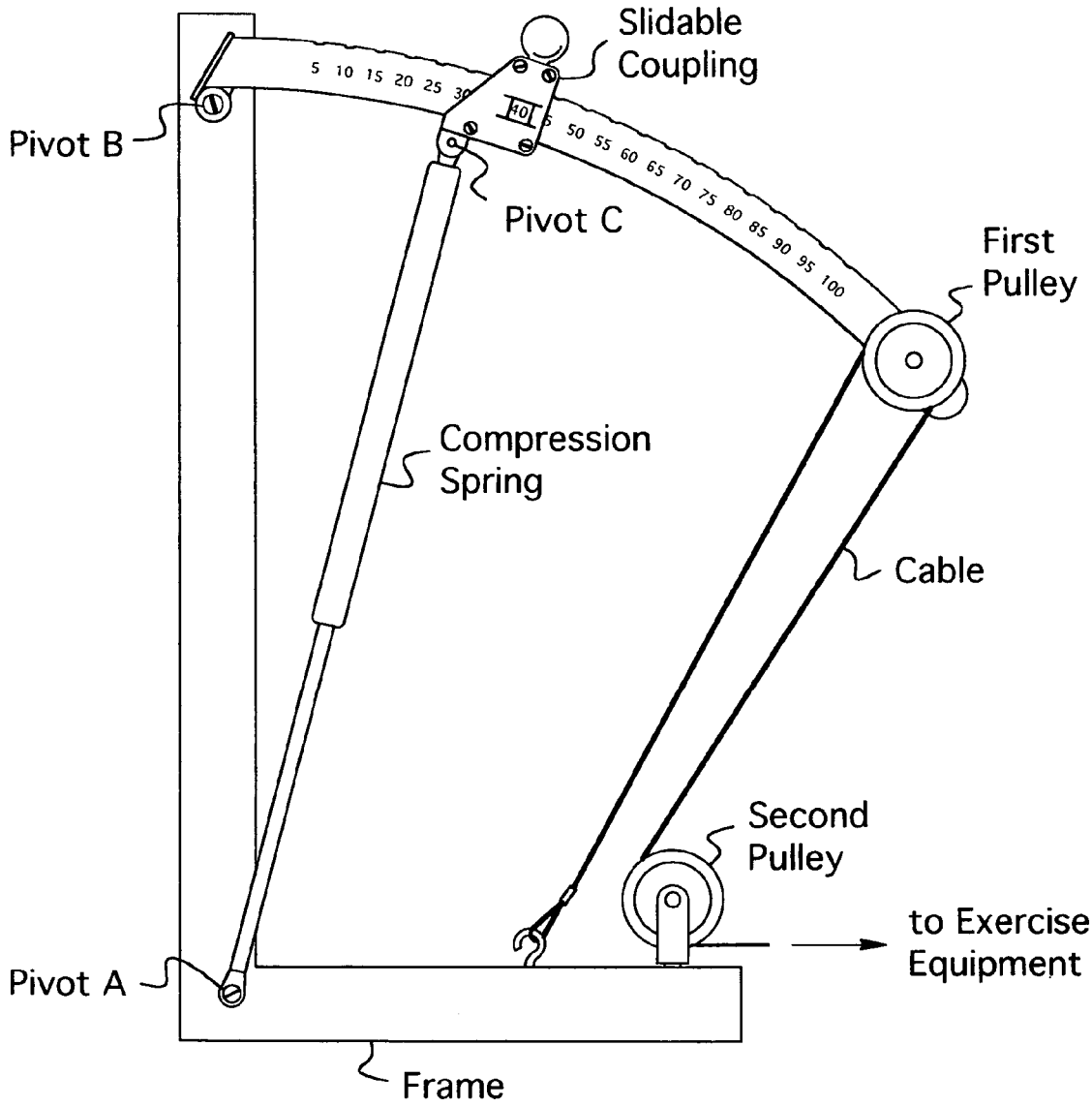
FIG. 1 illustrates the elements of the inventive loading device.

FIG. 1 of the drawings generally illustrates the basic elements of the invention. While it will be noted that FIG. 1 resembles the right side loading device arrangement of the exercise machine shown in FIG. 2, it should be appreciated that the loading device of the invention is applicable to all types of exercise machines where a finite variable load is to be conveniently delivered to a user. The invention comprises a rigid Frame on which are mounted a Pivot A and a Pivot B. A Compression Spring is coupled at its proximal end to Pivot A and at its distal end to a Pivot C that is connected to a Slidable Coupling which is movable to different discrete positions along a lever arm. The proximal end of the lever arm is connected to Pivot A and its distal end carries a First Pulley. A Second Pulley is connected to the Frame and a Cable is attached to the Frame and passes over the First and Second Pulleys to Exercise Equipment (not shown). A first leg of a force triangle is defined by the fixed distance between Pivot A and Pivot B, a second leg of the force triangle is defined by the distance between the Pivot B and the adjustment point selected by the Slidable Coupling, and the third leg is defined by the length of the Compression Spring. The ratio of the distance between Pivot B and Pivot C and the fixed distance between Pivot B and the First Pulley determines the leverage or mechanical advantage of the system. As will be described in further detail below, the construction of the Slidable Coupling and its arrangement on the Lever Arm enables the application of extremely low loading forces to the Exercise Equipment and provides a self-supporting system that requires a minimum of dexterity for effecting changes in loading.

Figure 2:
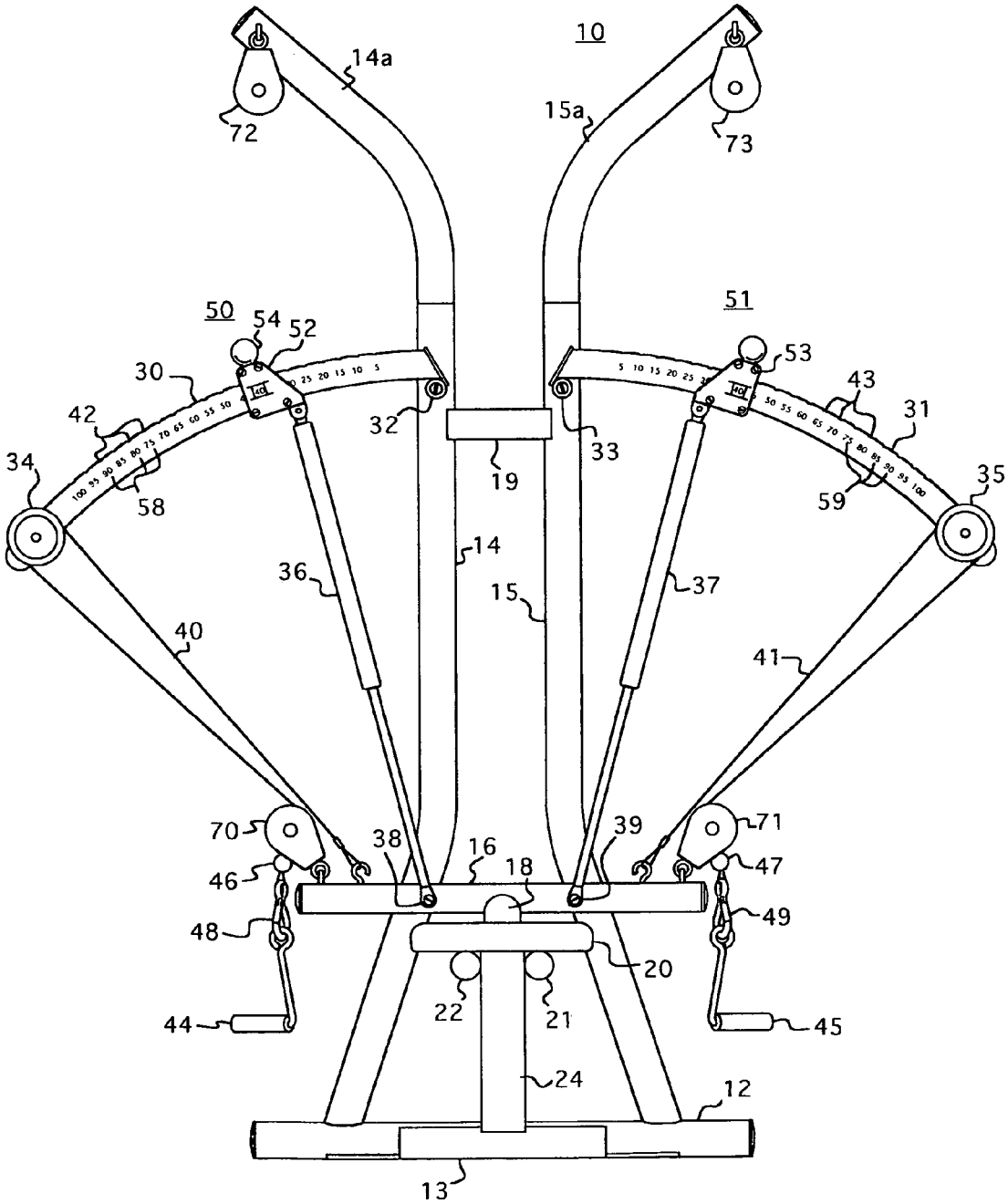
FIG. 2 is a front view of an exercise machine incorporating the inventive loading device.

Referring to FIG. 2, implementation of the invention in a common cable type of exercise machine 10 is illustrated. Exercise machine 10 generally comprises a plurality of tubing sections that are securely affixed to each other, preferably by welding, and includes a pair of foot members 12 and 13, and a pair of generally vertical upright members 14 and 15. Foot member 12 is welded to outwardly flared lower sections of upright members 14 and 15. A lower support member 16 is secured to upright members 14 and 15 and a pair of upper supports are defined by outwardly flared extensions 14*a* and 15*a* of upright members 14 and 15. These extensions support upper pulleys 72 and 73 (and cables, not shown) for performing certain exercises. A short, spaced, horizontal support 19 is welded between upright members 14 and 15 and a vertical piece 18 is secured between support member 16 and another horizontally extending base member (hidden by foot member 13). A seat 20 is supported on horizontally extending portions 21 and 22 affixed to vertical piece 18 at their rearward ends and to a vertical post 24 at their forward ends. The bottom of vertical post 24 is welded to foot member 13. It should be understood that the general configuration of the exercise machine is well known in the art and is used with various commercialized exercise machines that permit a user to perform different exercises with loads provided by weights, bow springs or other resistance systems. In the present invention, a pair of the loading devices described in FIG. 1 is used to provide different loads to a user.

A left lever arm 30 and a right lever arm 31 are pivotally secured at their proximal ends to upright members 14 and 15 at pivots 32 and 33, respectively. The lever arms 30 and 31 are also of rigid tubular construction and have pulleys 34 and 35, respectively, mounted at their distal ends. It will be appreciated that considerable forces are experienced during use of the exercise apparatus and that construction of the members must be substantial. Preferably, the pivots 32 and 33 comprise steel bushings that are welded to the proximal ends of lever arms 30 and 31, respectively.

Two compression gas springs 36 and 37 have their proximal ends secured to support member 16 at pivots 38 and 39, respectively, and are coupled at their distal ends to lever arms 30 and 31 by slidable coupling mechanisms 50 and 51, respectively. A left side cable 40 is secured to the left portion of support member 16, trained over pulley 34, passed through a lower pulley 70 that is also secured to the left portion of support member 16 and coupled, via a quick connect coupling 48, to a user handle 44. A right side cable 41 is similarly configured with respect to the right portion of support member 16, pulleys 35 and 71, quick connect coupling 49 and user handle 45. The lever arms are formed in arcs that match the radii of the free lengths of the compression springs. A series of holes 42 and 43 is formed along each of the upper surfaces of lever arm 30 and lever arm 31 to establish pluralities of load adjustment points, respectively.

For certain types of exercises the upper pulleys 72 and 73 may be required. In that event a supplemental pair of cables (not shown) having quick connect couplings similar to quick connect couplings 48 and 49 would be passed through pulleys 72 and 73. The user handles 44 and 45 would be removed from the ends of cables 40 and 41 and secured to the supplemental cables, the other ends of which would be attached to quick connect couplings 48 and 49. A pair of stop elements 46 and 47 on cables 40 and 41 keep the cables under slight tension when the exercise machine is not being used, which facilitates the interchanges of cables and handles, as described. Lower pulleys 70 and 71 are preferably nearly tangent to the distal end of lever arms 30 and 31, respectively, at the ends of the full excursions or strokes of the lever arms.

Figure 4:
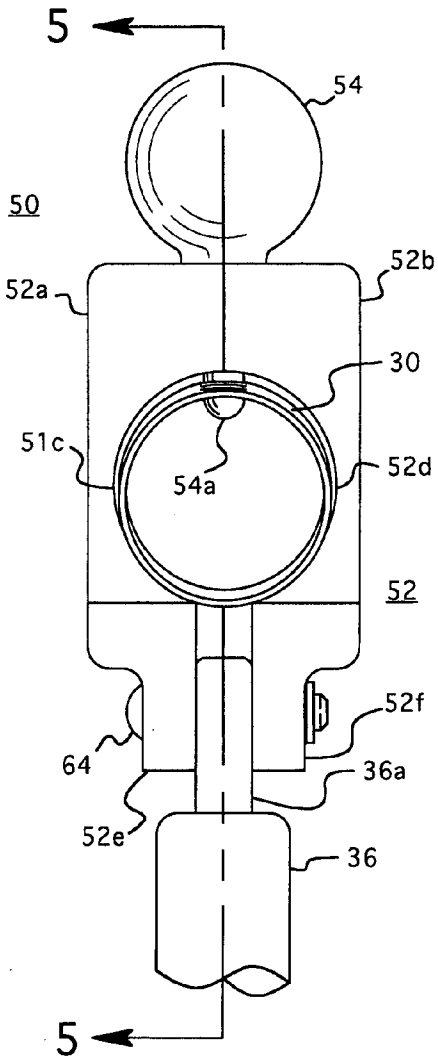
FIG. 4 is right elevation of the coupling mechanism of FIG. 3.
Figure 3:
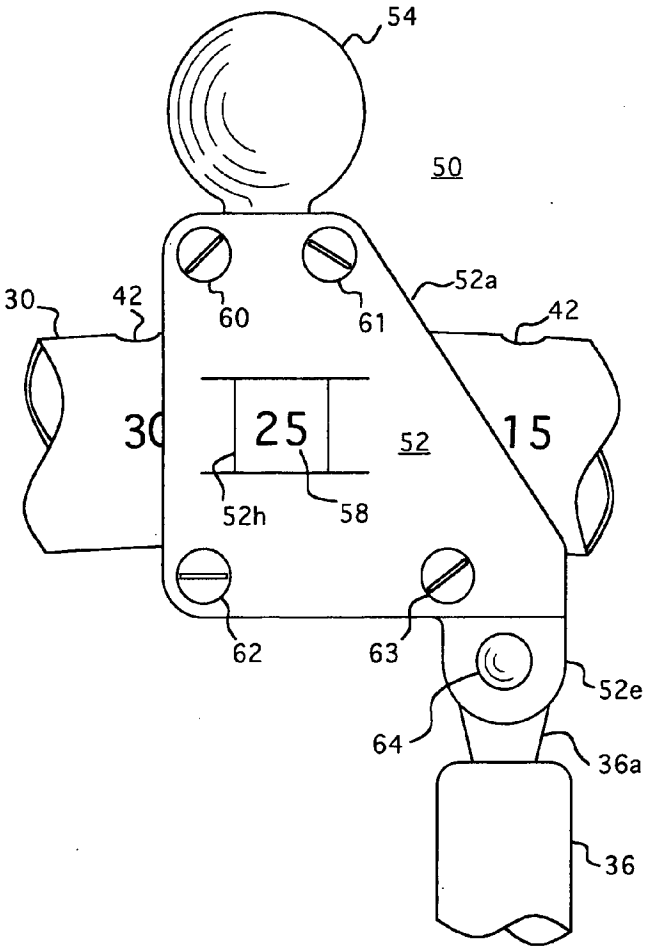
FIG. 3 is a enlarged view of the left side coupling mechanism of FIG. 2.
Figure 5:
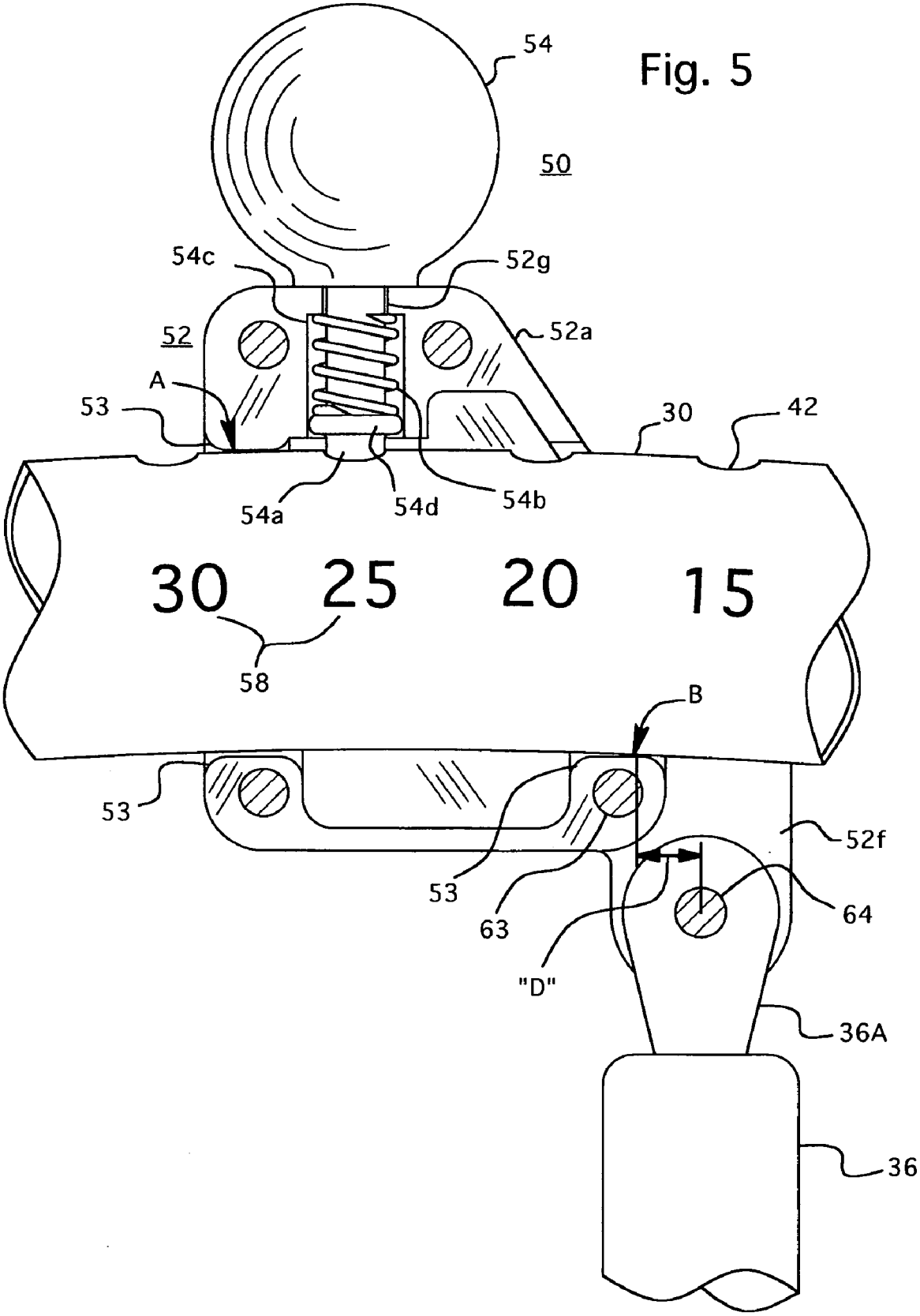
FIG. 5 is a sectional view taken along line 5-5 of FIG. 4.

Referring to FIGS. 3-5, left side slidable coupling 50 comprises a generally triangular-shaped body 52 formed from mating portions 52*a* and 52*b* that are secured together by four bolts 60-63. Matching semi-cylindrical openings 52*c* and 52*d* are formed in mating portions 52*a* and 52*b*, respectively and are sized to permit body 52 to be readily movable along curved lever arm 30. To facilitate such movement the ends of the openings that are formed in the mating portions are rounded, as indicated by reference character 53, resulting in smooth bearing surfaces at points A and B. The slidable coupling body 52 is preferably molded of a durable plastic material. The bottom apices 52*e* and 52*f* of mating portions 52*a* and 52*b*, respectively, have extensions that form a clevis for securing an eye 36*a* on the end of compression spring 36, by means of an axle pin 64. A ball-shaped handle 54 is provided for disengaging a spring-loaded plunger or pin 54*a*, that passes through a pin aperture 52*g* formed in mating portions 52*a* and 52*b*, and that is selectively engageable with the holes 42 that define the adjustment points along lever arm 30. Pin 54*a* is biased toward engagement with lever arm 30 by a compression spring 54*b* that is captivated in a cylindrical recess 54*c* formed in mating portions 52*a* and 52*b*. Pin 54*a* has an integral flange 54*d* that engages the bottom of compression spring 54*b*. Pin 54*a* has a rounded end to facilitate engagement with the holes 42 in lever arm 30. Weight markings or indicia 58 are provided on lever arm 30 to denote the loadings that correspond to the adjustment points. A viewing aperture 52*h* is formed in slidable coupling body 52 to indicate to the user the selected loading of the exercise machine.

Operation will be described in connection with the left side of exercise machine 10, it being understood that a similar operation is applicable to the right side. A user selects the weight or desired loading of the exercise machine by pulling upwardly on ball handle 54, thereby withdrawing pin 54*a* sufficiently from its associated one of holes 42 in lever arm 30 to enable slidable coupling body 52 to be moved along lever arm 30 to the desired adjustment point. When handle 54 is released, pin 54*a* engages the hole 42 corresponding to the selected adjustment point. Alignment of pin 54*a* with the holes 42 at the adjustment points along lever arm 30 is facilitated by visually aligning the viewing aperture 52*h* and weight markings 58. Thus load changing is straightforward and readily accomplished since compression spring 36 is fully extended and acting only to support the weight of lever arm 30 (and the slight tension load of cable 40) and since slidable coupling body 52 is secured to compression spring 36 and captivated on lever arm 30. It will be appreciated that the initial compression force of the compression spring in relation to the position of the adjustment point that is closest to upright member 14 and to the weight of the lever arm is chosen such that, under idle or conditions of no use, i.e., with no force being applied to cable 40 by the user, compression spring 36 supports the weight of the lever arm to maintain the integrity of the arrangement. Thus, in the preferred embodiment of the invention there is no need for the user to hold any of the parts to keep them from falling because none of the components of the force triangle are loose.

With particular reference to FIG. 5, it should be noted that a distance "D" is established between bearing surface B on slidable coupling body 52 and axle pin 64, the attachment point of compression spring 36. The arrangement effectively imparts a slight torque to slidable coupling body 52 which forces its surfaces A and B into engagement with lever arm 30. It should also be appreciated that this relationship is maintained throughout the excursion of the lever arm, irrespective of the load setting. With it, the clearances necessary to enable the sliding coupling to be readily movable along the slightly curved lever arm do not result in any annoying clicks or similar noises resulting from the slidable coupling body rocking on the lever arm during excursions of the lever arm.

Another important aspect of the invention, specifically the described arrangement for imparting a slight torque to the slidable coupling body 52, is that the position of axle pin 64 may be chosen to be at the extreme inboard end of the slidable coupling body 52 thus allowing the axle pin 64 of the compression spring to be brought very close to its corresponding upper pivot. The arrangement permits very small loadings (about five pounds) for the user, which is a significant benefit in that many users want or can only perform certain exercises with such small loadings.

What has been described is a novel loading device for an exercise machine that uses force triangles in which resistive load changes may be readily accomplished without requiring manual dexterity on the part of the user nor an interruption of an exercise routine. It should be appreciated by those skilled in the art that while use of the invention has been described in connection with a specific form of exercise machine, the invention is applicable to many types of exercise apparatus. For example, practice of the invention does not require the use of two lever arms and the invention is to be limited only as defined in the claims.

The invention claimed is:

1. An exercise machine comprising:

a frame including a rigid upright member;

a pair of upper pivot and a pair of lower pivots mounted on said upright member;

the distances between respective ones of said upper pivots and said lower pivots defining first legs of left and right force triangles;

a pair of lever arms, each having a proximal end coupled to a respective one of said upper pivots and a distal end adapted for receiving user forces;

said lever arms each including a plurality of adjustment points;

a pair of slidable couplings, each movable over a respective one of said lever arms, for selective engagement with any of said respective pluralities of adjustment points;

a pair of compression springs, each connected between a respective one of said lower pivots and a respective one of said slidable couplings;

the distances between said upper pivots and the connections between said compression springs and said slidable couplings defining respective second legs of said force triangles;

said compression springs each having a free length defining respective third legs of said force triangles; and each of said compression springs readily supporting its corresponding one of said lever arms when the corresponding one of said slidable couplings is in any of said corresponding adjustment points, in the absence of said user forces.

2. The exercise machine of claim 1 wherein said compression springs comprises pressurized gas cylinders.

3. The exercise machine of claim 2, wherein:

each said lever arm is formed with a radius matching the free length of its corresponding one of said compression springs;

wherein each said lever arm includes a plurality of holes corresponding to said adjustment points; and wherein each said slidable coupling includes a spring-loaded pin that selectively engages any of said plurality of holes in its corresponding one of said lever arms for locking said slidable coupling to said lever arm.

4. the exercise machine of claim 3, wherein said lever arms are tubular and wherein said slidable couplings each comprise a body having;

a clevis for connection to its corresponding one of said compressed gas springs;

a recess for said spring-loaded pin; and a pin aperture alignable with said plurality of holes in the corresponding one of said lever arms.

5. The exercise machine of claim 4, wherein each said clevis is located on said body to provide a slight torque to said body throughout excursions of said lever arm.

6. The exercise machine of claim 5, wherein each said lever arm includes a plurality of indicia corresponding to said adjustment points and wherein each said body includes a viewing aperture alignable with its corresponding plurality of said indicia.

* * * * *